US009219316B2

(12) United States Patent
Katipally

(10) Patent No.: US 9,219,316 B2
(45) Date of Patent: Dec. 22, 2015

(54) BROADBAND IN-LINE ANTENNA SYSTEMS AND RELATED METHODS

(71) Applicant: Raja Reddy Katipally, Cheshire, CT (US)

(72) Inventor: Raja Reddy Katipally, Cheshire, CT (US)

(73) Assignee: Alcatel-Lucent Shanghai Bell Co. Ltd., Shanghai (CN)

( * ) Notice: Subject to any disclaimer, the term of this patent is extended or adjusted under 35 U.S.C. 154(b) by 369 days.

(21) Appl. No.: 13/715,182

(22) Filed: Dec. 14, 2012

(65) Prior Publication Data

US 2014/0168027 A1 Jun. 19, 2014

(51) Int. Cl.

| | |
|---|---|
| ***H01Q 19/00*** | (2006.01) |
| ***H01Q 21/29*** | (2006.01) |
| ***H01Q 1/24*** | (2006.01) |
| ***H01Q 1/52*** | (2006.01) |
| *H01Q 15/14* | (2006.01) |
| *H01Q 21/08* | (2006.01) |
| *H01Q 21/28* | (2006.01) |

(52) U.S. Cl.

CPC ..... *H01Q 21/29* (2013.01); *H01Q 1/246* (2013.01); *H01Q 1/521* (2013.01); *H01Q 1/526* (2013.01); *H01Q 15/14* (2013.01); *H01Q 21/08* (2013.01); *H01Q 21/28* (2013.01)

(58) Field of Classification Search

CPC ..... H01Q 19/00

USPC ..... 343/833, 797, 810

See application file for complete search history.

(56) References Cited

U.S. PATENT DOCUMENTS

| | | | | |
|---|---|---|---|---|
| 7,868,843 | B2 * | 1/2011 | Borau et al. | 343/844 |
| 8,497,814 | B2 * | 7/2013 | Puente et al. | 343/893 |
| 8,593,365 | B2 * | 11/2013 | Moon et al. | 343/816 |
| 2003/0011526 | A1 * | 1/2003 | Gottwald et al. | 343/711 |
| 2004/0201543 | A1 * | 10/2004 | Gottl et al. | 343/912 |
| 2005/0057417 | A1 * | 3/2005 | Teillet et al. | 343/797 |
| 2005/0225498 | A1 * | 10/2005 | Koparan et al. | 343/895 |
| 2006/0114168 | A1 * | 6/2006 | Gottl et al. | 343/797 |

FOREIGN PATENT DOCUMENTS

| | | | |
|---|---|---|---|
| EP | 1406348 | A2 | 4/2004 |
| EP | 1667278 | A1 | 6/2006 |
| WO | WO 2012159406 | A1 | 11/2012 |

* cited by examiner

*Primary Examiner* — Huedung Mancuso

(74) *Attorney, Agent, or Firm* — Capitol Patent & Trademark Law Firm, PLLC

(57) ABSTRACT

An antenna structure includes an in-line portion for radiating electromagnetic energy signals in low and high frequency ranges. The in-line portion may be constructed to provide improved control beam width stability of a high-frequency, antenna radiating element. The antenna structure includes one or more shaped structure configured to improve the beam width stability and cross-polarization of one or more high-frequency elements, and to shift resonance from the high-frequency elements to a range that is below the range of a low-frequency, antenna radiating element.

18 Claims, 6 Drawing Sheets

BROADBAND IN-LINE ANTENNA SYSTEMS AND RELATED METHODS

RELATED APPLICATION

This application is related to U.S. patent application Ser. No. 13/669,040 ("'040 application") and incorporates by reference herein, as if set forth in full herein, those parts of the '040 application that are consistent with the text and drawings disclosed herein. In the event any part is inconsistent, the text and drawings of the instant application govern.

BACKGROUND

Antennas with dipole radiating elements, both low frequency range and high frequency range, are commonly used in the communications industry.

Particularly, panel-type base station antennas, such as those used in mobile communication systems, are often dual polarization antennas. That is, these antennas often radiate radio frequency (RF) signals/energy on two opposite polarizations. Most dual polarization antennas are made with dual polarized elements, either by including a single patch element fed in such a manner to create a dual polarized structure, or by combining two linear polarized dipoles into one, thereby making a single, dual polarization element.

Conventional, dual polarization dipole radiating elements often have problems with beam width stability. It is, therefore, desirable to provide antennas with dipole radiating elements with improved beam width stability.

Additionally, many conventional panel-type base station antennas are multi-band (e.g., dual band or triple band) antennas. In such antennas, there are often problems with resonance from high band dipole radiating elements creating interference with low band frequencies. It is, therefore, desirable to provide antennas with reduced interference due to resonance from high band radiating elements.

It is further desirable to improve cross-polarization (ratio of power in a desired polarization to power in the opposite polarization) in dipole antennas.

Still further, antennas that include a plurality of dipole radiating elements may experience issues with poor isolation between adjacent radiating elements. It is, therefore, desirable to provide features that improve isolation between opposite polarities of adjacent radiating elements.

SUMMARY

Exemplary embodiments of broadband, in-line antenna structures and related methods for configuring such structures are described herein. According to an embodiment a broadband antenna structure is provided that comprises: a first high-frequency, antenna radiating element operable to transmit frequencies over a first high-frequency range and a first shaped structure configured to surround sides of the first high-frequency, antenna radiating element, and operable to effect characteristics of a beam radiated from the first high-frequency, antenna radiating element; and an in-line antenna portion comprising, a second high-frequency, antenna radiating element operable to transmit frequencies over a second high-frequency range, a low-frequency, antenna radiating element operable to transmit frequencies over a low frequency range having a beam center substantially the same as a beam center of the second high-frequency, antenna radiating element, and a second shaped structure configured to surround sides of the second high-frequency, antenna radiating element, and operable to effect characteristics of a beam radiated from the second high-frequency, antenna radiating element.

The low-frequency, antenna radiating element may comprise, for example, a substantially one-piece element, may have an electrical length of ¼ wavelength, and may be operate operable to transmit frequencies over a low-frequency range of 698 to 960 megahertz, for example. In addition, the low frequency element may comprise a tapered portion for reducing the effects of cross-polarization. In comparison, in one embodiment of the invention the first high-frequency, antenna radiating element may be operable to transmit frequencies over a first high-frequency range of 1700 to 2200 megahertz, while the second high-frequency, antenna radiating element may be operable to transmit frequencies over a second high-frequency range of 2200 to 2700 megahertz. In an alternative embodiment, both the first and second high-frequency radiating elements may be operable to transmit frequencies over the same range (e.g., 1700 to 2700 megahertz).

In one embodiment, a radiating surface of the second high-frequency, antenna radiating element may be substantially aligned with a top surface of the low-frequency, antenna radiating element, and each of the first and second shaped structures may comprise a conically shaped structure. In alternative embodiments of the invention the conically shaped structure may comprise a circular shaped top edge, or a rectangular shaped top edge to give just a few examples.

The antenna structure may further comprise a raised supporting section operable to support at least the second high-frequency, antenna radiating element, and/or first and second beam width stabilizing structures operable to provide stabilization for the first and second high-frequency elements. In a further embodiment, each of the stabilizing structures may further comprise an extended low-frequency beam width stabilizing structure operable to provide stabilization for the low frequency element.

Yet further, in an additional embodiment an antenna structure may further comprise first and second tuning sections for adjusting the beam width stability of the low frequency element and first and second high frequency elements.

In addition to providing antenna structures, the present invention provides related methods for configuring such structures. For example, in one embodiment a method for configuring an antenna structure may comprise: configuring a first shaped structure to surround sides of a first high-frequency, antenna radiating element, and operable to effect characteristics of a beam radiated from the first high-frequency, antenna radiating element; configuring a second shaped structure to surround sides of a second high-frequency, antenna radiating element, and operable to effect characteristics of a beam radiated from the second high-frequency, antenna radiating element; and transmitting a beam of a low-frequency, antenna radiating element such that a beam center of the beam is substantially the same as a beam center of a beam transmitted by the second high-frequency, antenna radiating element.

In additional embodiments, one or more methods may comprise: configuring a radiating surface of the second high-frequency, antenna radiating element to be substantially aligned with a top surface of the low-frequency, antenna radiating element; and/or configuring a raised supporting section to support at least the second high-frequency, antenna radiating element; and/or configuring first and second beam width stabilizing structures to provide stabilization for the first and second high-frequency elements; and/or configuring extended low-frequency beam width stabilizing structures to provide stabilization for the low frequency element; and/or configuring first and second tuning sections to adjust beam width stabilities of the low frequency element and first and second high frequency elements.

In addition to the antenna structures and methods described above, the present invention also provides methods for assembling and/or modeling an antenna structure. One such method may comprise: updating a model of an antenna structure by adding antenna components; simulating electromagnetic fields associated with the generated antenna structure based on transmission signals; determining whether the electromagnetic fields may be optimized; receiving inputs to adjust a model for one or more of the antenna components; and mounting antenna components on a chassis to form an antenna structure. The antenna components may comprise one or more of the components described above and/or herein, including: a first shaped structure surrounding sides of a first high-frequency, antenna radiating element, and operable to effect characteristics of a beam radiated from the first high-frequency, antenna radiating element, and a second shaped structure surrounding sides of a second high-frequency, antenna radiating element, and operable to effect characteristics of a beam radiated from the second high-frequency, antenna radiating element.

Additional embodiments of the invention will be apparent from the following detailed description and appended drawings.

DETAILED DESCRIPTION, INCLUDING EXAMPLES

Figure 1:
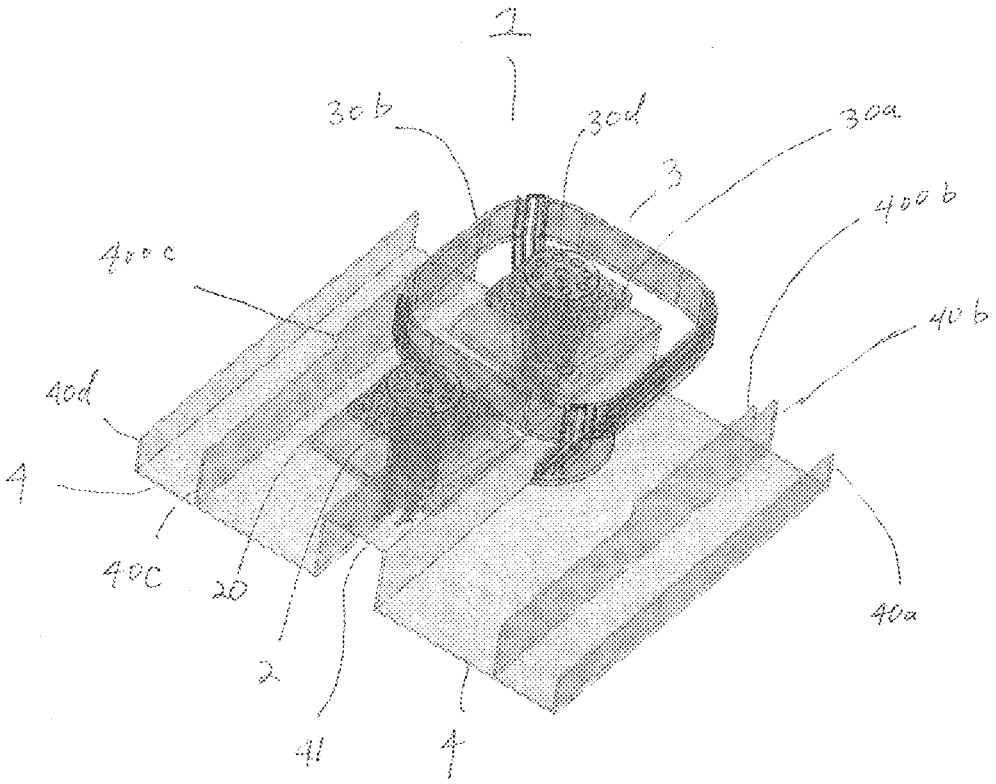
FIG. 1 depicts an antenna structure according to an embodiment of the invention.

Exemplary embodiments of an antenna structure, components and related methods are described herein in detail and shown by way of example in the drawings. Throughout the following description and drawings, like reference numbers/characters refer to like elements.

It should be understood that, although specific exemplary embodiments are discussed herein there is no intent to limit the scope of present invention to such embodiments. To the contrary, it should be understood that the exemplary embodiments discussed herein are for illustrative purposes, and that modified, equivalent and alternative embodiments may be implemented without departing from the scope of the present invention.

Specific structural and functional details disclosed herein are merely representative for purposes of describing the exemplary embodiments. The inventions, however, may be embodied in many alternate forms and should not be construed as limited to only the embodiments set forth herein.

It should be noted that some exemplary embodiments may be described as processes or methods depicted in flowcharts. Although the flowcharts may describe the processes/methods as sequential, the processes/methods may be performed in parallel, concurrently or simultaneously. In addition, the order of each step within a process/method may be re-arranged. A process/method may be terminated when completed, and may also include additional steps not included in a flowchart. The processes/methods may correspond to functions, procedures, subroutines, subprograms, etc., completed by an antenna structure and/or component.

It should be understood that, although the terms first, second, etc. may be used herein to describe various antenna components, these components should not be limited by these terms. These terms are used merely to distinguish one component from another. For example, a first component could be termed a second component, or vice-versa, without departing from the scope of disclosed embodiments. As used herein, the term "and/or" includes any and all combinations of one or more of the associated listed items. It should be understood that if a component is referred to as being "connected" or "attached" or "mounted" to another component it may be directly connected or attached or mounted to the other component or intervening components may be present, unless otherwise specified. Other words used to describe connective or spatial relationships between components (e.g., "between," "adjacent," etc.) should be interpreted in a like fashion. As used herein, the singular forms "a," "an" and "the" are intended to include the plural forms as well, unless the context clearly indicates otherwise.

Unless specifically stated otherwise, or as is apparent from the discussion, the term "determining" refers to the action and processes of a computer system, or similar electronic computing device, that manipulates and transforms data represented as physical, electronic quantities within the computer system's registers and memories, for example, into other data similarly represented as physical quantities within the computer system's memories or registers or other such information storage, transmission or display devices. Unless specifically stated otherwise, or as is apparent from the discussion, the term "configuring" means at least the design of an antenna structure that includes identified components, or the positioning of one or more such antenna components. Yet further the phrase "operable to" means at least: having the capability of operating to complete, and/or is operating to complete, specified features, functions, process steps; or having the capability to meet desired characteristics, or meeting desired characteristics.

As used herein, the term "embodiment" refers to—an embodiment of the present invention—. Further, the phrase "base station" may describe, for example, a transceiver in communication with, and providing wireless resources to, mobile devices in a wireless communication network which may span multiple technology generations. As discussed herein, a base station includes the functionality typically associated with well-known base stations in addition to the capability to perform features, functions and methods related to the antenna structures discussed herein.

FIG. 1 depicts an exemplary antenna structure 1 according to one embodiment. The antenna structure 1 may be a part of, for example, a base station panel antenna for a mobile communication system. As shown in FIG. 1, the antenna structure 1 may comprise a reflector plate or chassis 4, a first high-frequency, dipole radiating element 2 (hereinafter "first high-frequency element") mounted on the chassis 4 configured and operable to transmit and/or receive energy/signals over a first high-frequency range (e.g., 1700 to 2700 megahertz (MHz)), and an in-line antenna portion 3 mounted on the chassis 4. In one embodiment of the invention, sides of the first high-frequency element 2 may be surrounded by a first shaped structure 200*c* (e.g., baffle) (see FIG. 2), that is operable to effect characteristics of a beam radiated from the first high-frequency element 2. In an embodiment of the invention the in-line antenna portion 3 may comprise: (i) a second high-frequency, dipole antenna radiating element ("second high-frequency element") 30*a* configured and operable to transmit and/or receive energy/signals over a second high-frequency range, (ii) a low-frequency, dipole antenna radiating element 30*b* ("low-frequency element") configured and operable to transmit and/or receive energy/signals over a low frequency range (e.g. 698 to 960 MHz) and having a beam width whose center is substantially the same as a center of a beam width of the second high-frequency element 30*a*, and (iii) a second shaped structure 30*c* (e.g., baffle) (see FIG. 2) configured to surround sides of the second high-frequency element 30*a*, and operable to effect characteristics of a beam radiated from the second high-frequency element 30*a*, and to electrical isolate the second high-frequency element 30*a* from the low-frequency element 30*b*. It should be understood, however, that in alternative embodiments the high-frequency elements 2, 30*a* and low frequency element 30*b* may be configured and be operable to transmit and receive energy/signals over different frequency ranges. The frequency range of the second high-frequency element may be the same as the frequency range for the first high-frequency element (e.g., 1700 to 2700 megahertz (MHz)) or may be different (e.g., 2200 to 2700 megahertz (MHz)).

Still referring to FIG. 1, the chassis 4 may comprise first and second beam width stabilizing structures 40*b*, 40*c*, (e.g., walls) where each of the structures 40*b*,40*c* may further comprise an extended low-frequency beam width stabilizing structure 400*b*, 400*c*. In more detail, each of the structures 40*b*,40*c* may be positioned and dimensioned (e.g. an electrical length of approximately ¼ wavelength) in order to be operable to provide stabilization for the first and second high-frequency elements 2, 30*a* (e.g., beam width stability across an operating frequency range of 1700 to 2700 MHz of +/−5 degrees) while extended structures 400*b*,400*c* are positioned and dimensioned (e.g. an electrical length of approximately ⅛ wavelength) in order to be operable to provide stabilization for the low frequency element 30*b* (e.g., beam width stability across an operating frequency range of 698 to 960 MHz of +/−5 degrees).

Figure 2:
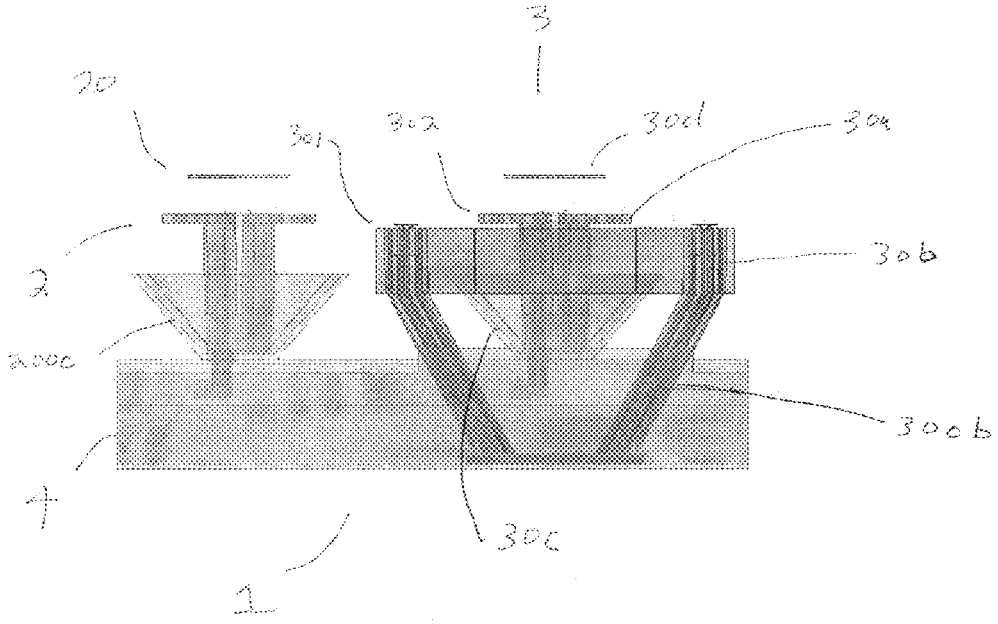
FIG. 2 depicts a side view of the antenna structure in FIG. 1 according to an embodiment of the invention.
Figure 3:
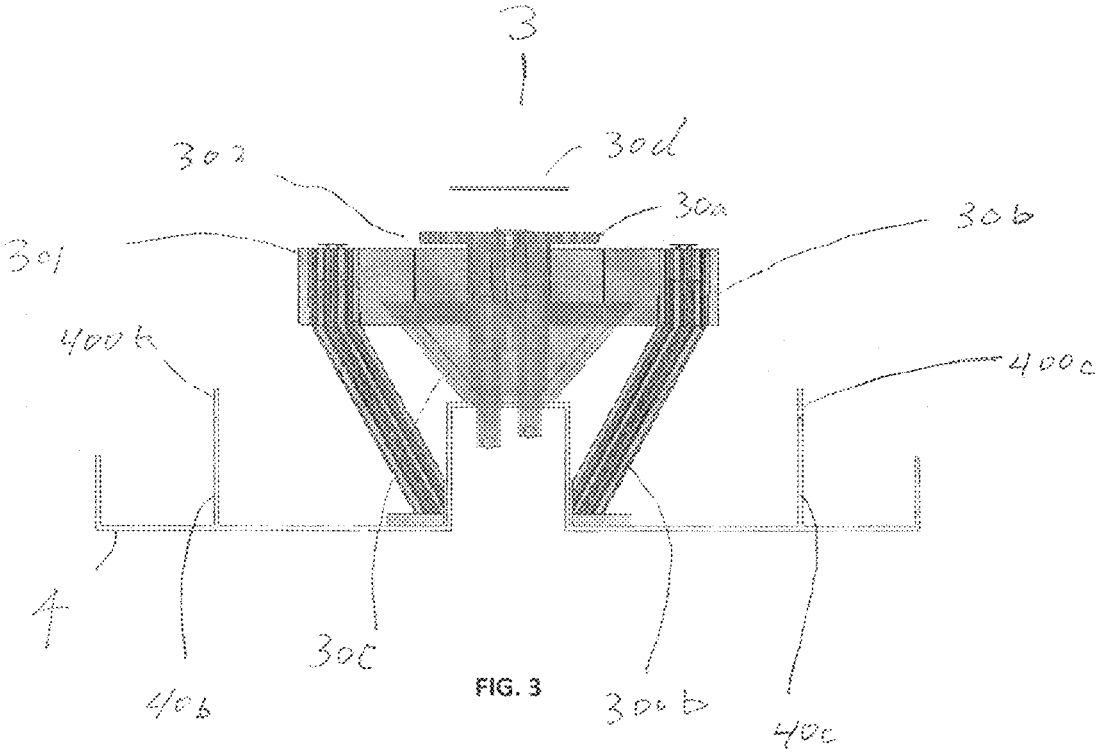
FIG. 3 depicts a side view of an in-line portion of the antenna structure in FIG. 1 according to an embodiment of the invention.

In addition to the stabilizing structures the antenna structure 1 may further comprise supporting structure 41 and first and second tuning sections 20, 30*d*. In the embodiment in FIG. 1 the supporting structure 41 is depicted as a raised or elevated, supporting structure that is operable to support and elevate at least the first high-frequency element 2, and second high-frequency element 30*a*. By elevating the element 30*a* the supporting structure 41 may be operable to reduce the electromagnetic interference between the element 30*a* and low-frequency element 30*b*. As for the tuning sections 20, 30*d*, in one embodiment of the invention these sections be operable to tune or match the input impedance of a respective high-frequency element 2,30*a* (e.g., based on voltage standing wave ratios (VSWR)) in order to further adjust the beam width stability of the low frequency element and first and second high frequency elements. In one embodiment the tuning sections 20, 30*d* may comprise passive radiators configured and operable to improve the input VSWR of their respective high-frequency elements 2,30*a*. Each passive radiator 20, 30*d* may be electrically isolated from its respective high-frequency element 2,30*a* and may be a substantially flat, disc-shaped member as shown in FIGS. 2 and 3. However, it should be understood that the shape, size and orientation of the passive radiators 20, 30*d* may be varied from antenna structure to antenna structure in order to provide a desired performance.

The structure 1 shown in FIG. 1 may be a periodic structure that may be repeated as many times as desired in order 1 to meet desired specifications. In other words, the structure 1 shown in FIG. 1 may be extended to include a greater number of first high-frequency elements and in-band antenna portions.

Still referring to FIG. 1, the chassis 4 may be a unitary structure, or it may be constructed of multiple parts that are fastened or soldered together, for example. The chassis 4 may be constructed of any conductive material, such as aluminum, copper, bronze or zamak, for example. However, it should be understood that the chassis 4 may be constructed of other materials.

Referring now to FIGS. 2 and 3, there is depicted a side view of the antenna structure in FIG. 1 according to an embodiment of the invention. While FIG. 2 depicts both the first high-frequency element 2 and in-line portion 3, FIG. 3 depicts just the in-line portion 3. The low-frequency element 30*b* may be constructed as a substantially one-piece or unitary structure by, for example, molding, casting, or carving. In addition, the low-frequency element 30*b* may be constructed using materials such as copper, bronze, plastic, aluminum, or a zamak alloy, for example. If the material used is a type that cannot be soldered, such as plastic or aluminum, then the low-frequency element 30*b*, once formed, may be covered or plated, in part or in whole, with a metallic material that may be soldered, such as copper, silver, or gold.

As depicted in both FIGS. 2 and 3, the second shaped structure 30*c* may comprise a conically shaped structure. In alternative embodiments the second structure 30*c* may comprise rectangular (including square), circular or another shape selected to control the beam stability of a signal transmitted by the second high-frequency element 30*a*. Further, the first shaped structure 200*c* may comprise similarly shaped structures to control the beam stability of a signal transmitted by the first high-frequency element 2. In addition, the first and second shaped structures 30*c*, 200*c* may be configured and operable to improve low-frequency resonance problems that may occur between the first and second high-frequency elements 2, 30*a* and the low-frequency element 30*b*.

Though not shown in FIGS. 2 and 3, the high-frequency elements and low-frequency element may be attached to the chassis 4 by fasteners (e.g., screws) or soldering, for example.

Turning to the low frequency element 30*b*, as depicted in FIGS. 2 and 3 element 30*b* may comprise a tapered leg portion 300*b*. This has an effect of increasing the physical height of a leg of the element without increasing the overall height of the element, which in turn may help improve (e.g., reduce) the effects of cross-polarization.

In an embodiment of the invention, a top surface (e.g., edge of the surface) 301 of the low-frequency element 30*b* is substantially aligned with a radiating surface 302 of the second high-frequency element 30*a*. Such a configuration may be operable to reduce electromagnetic interference between the two radiating elements. In the embodiments depicted in FIGS. 2 and 3 surface 302 appears to be slightly above or out of alignment with surface 301. This is just for ease of viewing. In actuality, the two surfaces may be substantially aligned along the same plane. That said, in an alternative embodiment the two surfaces may be slightly out of alignment in order to meet required operating specifications.

Figure 4:
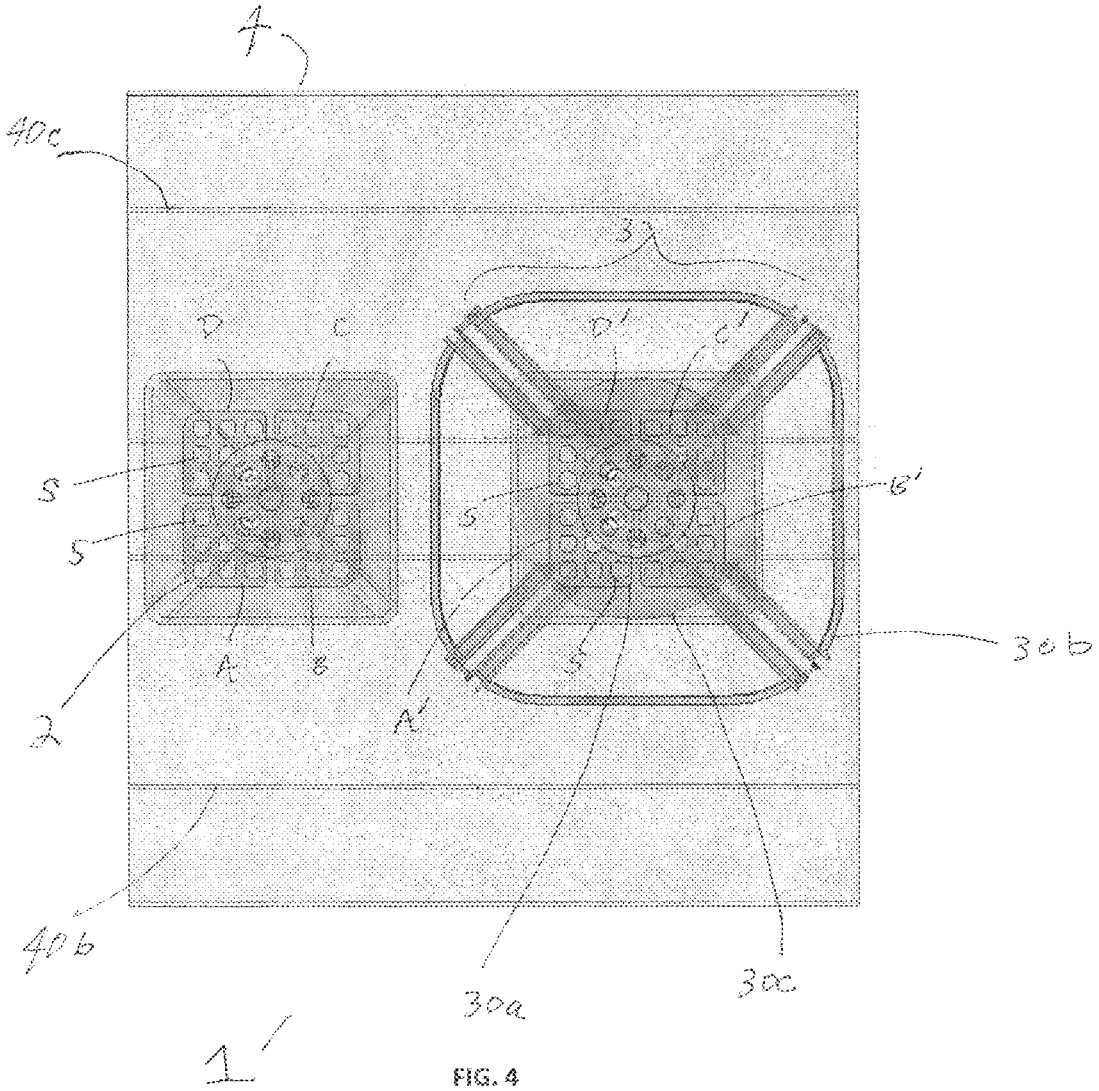
FIG. 4 depicts a top view of an antenna structure according to an embodiment of the invention.

FIG. 4 depicts a top view of the antenna structure 1 according to an embodiment of the invention. As shown, the second shaped structure 30*c* surrounding the second high-frequency element 30*a* may comprise a circular shaped top edge. In alternative embodiments this shape may be altered, for example to a rectangular shaped top edge or pentagon shape to meet beam shaping requirements of a particular antenna structure. Further, the first shaped structure 200*c* may also comprise similar shaped top edge(s). Still further, low-frequency element 30*b* may also comprise a rectangular shaped top edge (as shown) or another shape. In an embodiment of the invention, the electrical length of the low-frequency element 30*b* may be ¼ wavelength.

In accordance with embodiments of the invention, the high-frequency elements 2, 30*a* may be constructed as unitary structures formed by molding, casting, or carving, for example. In addition, the high-frequency elements may be constructed using materials such as copper, bronze, plastic, aluminum, or a zamak alloy, for example. If the material used is a type that cannot be soldered, such as plastic or aluminum, then the high-frequency elements, once formed, may be covered or plated, in part or in whole, with a metallic material that may be soldered, such as copper, silver, or gold. Similarly, the shaped structures 30*c*, 200*c* may be constructed as unitary structures formed by molding, casting, or carving, for example. In addition, the shaped structures 30*c*, 200*c* may be constructed using materials such as copper, bronze, plastic, aluminum, or a zamak alloy, for example. If the material used is a type that cannot be soldered, such as plastic or aluminum, then the shaped structures 30*c*, 200*c* once formed, may be covered or plated, in part or in whole, with a metallic material that may be soldered, such as copper, silver, or gold. The shaped structures 30*c*, 200*c* may be made from the same material or a different material than their respective high-frequency element 2, 30*a*.

Still referring to FIG. 4, each of the high-frequency elements 2, 30*a* may comprise a plurality of arms A, B, C, D and A', B', C', D', respectively. In turn each of the arms may further comprise a plurality of slots "s" in, for example, a fractal pattern such as a volume (three-dimensional) Sierpinski carpet pattern or other volume pattern, for example. The size and shape of the high-frequency elements 2, 30*a* may vary from antenna structure to antenna structure and still be within the scope of the invention.

In accordance with an embodiment of the invention, the shaped structures 30*c*, 200*c* may be attached or connected to the chassis 4 using fasteners (not shown), such as screws. Alternatively, the shaped structures may be soldered to the chassis 4.

The configuration and construction of antenna structures provided by the embodiments shown and described herein provide improved performance characteristics and tunability for various applications. In particular, the antenna structures may provide improved performance when operating the low-frequency element 30*b* is operating in a frequency range of about 698 MHz to about 960 MHz and operating the high-frequency elements 2,30*a* in a frequency range of about 1700 to about 2700 MHz. More specifically, the construction and configuration of the in-line portion 3 may provide improved cross-polarization in the low frequency range (e.g., greater than 10 db at +/−60 degrees or sector edge) with respect to a main axis or bore sight. Additionally, the construction and configuration of the in-line portion 3 and first high-frequency element 2 cooperate to improve cross-polarization (greater than 10 dB at +/−60 degrees or sector edge) with respect to a main axis or bore sight and beam width stability in the high frequency range. The shaped structures 30*c*, 200*c* may work in conjunction with their respective high-frequency elements 2, 30*a* to improve beam width stability and cross-polarization in the high frequency range.

Furthermore, the configuration and construction of the shaped structures 30*c*, 200*c* may minimize or eliminate the problem of low frequency resonance from the high-frequency elements 2, 30*a*. In one embodiment the shaped structures 30*c*, 200*c* may be configured such that the effective electrical length of the first and second high-frequency elements 2, 30*a* may be about ½ wavelength diagonally of higher frequencies of a high frequency pass range/band (2200 MHz), thereby shifting low frequency resonance from the high-frequency elements 2, 30*a* below 680 MHz. Thus, resonance from the high-frequency elements 2, 30*a* may be shifted below the bottom end of the operating frequency range (about 698 MHz) of the low-frequency element 30*b*.

Still further, the shaped structure 30*c* may be configured and operable to improve input matching to an input signal received by the high-frequency element 30*a*.

The antenna structures shown in FIGS. 1-4 may provide enhanced performance and design flexibility through the incorporation of passive radiators 20, 30*d*. The passive radiators 20, 30*d* may enable the gain of the high-frequency elements 2,30*a* to be increased with minimal or no adverse effects on other performance characteristics of the antenna structure 1.

It should be understood that the configuration of the antenna structures disclosed herein may be altered in order to achieve a desired performance with regard to cross-polarization, beam width stability, isolation, resonance, input matching and other performance criteria.

As indicated above, the disclosed antenna structure 1 may be configured to optimize the beam widths of the high-frequency elements and low-frequency element, cross-polarization of the high-frequency elements and low-frequency element, low frequency resonance of the high-frequency elements, and input matching in the high-frequency elements. Due to the configuration of the in-line portion 3, including the addition of the shaped structure 30*c*, the beam width of the high-frequency element 30*a* may be controlled more accurately. Particularly, the design of different beam width antenna structures that meet desired performance criteria for isolation, cross-polarization, resonance and input matching, for example, may be achieved by modifying the configuration and/or construction of the shaped structures 30*c*, 200*c* (and, optionally, the passive radiators 20, 30*d*) without completely changing the antenna structure or changing the radiating elements of the antenna structure.

The configuration of the shaped structures 30*c*, 200*c* may be generally selected based on models of low-frequency elements (such as element 30*b*), high-frequency elements (such as elements 2, 30*a*) and optional passive radiators (such as passive radiators 20,30*d*). For example, these elements and radiators may be modeled using a known 3D computer aided drafting (CAD) system. The models may be merged together to generate an antenna structure 1, for example. Parameters associated with the merged model may then be ported to a known 3D Full-wave Electromagnetic Field Simulator. Transmission signals may be simulated and magnetic field results or simulated beams may be generated. The simulated beams may be analyzed for desired beam widths, isolation, cross-polarization, resonance and input matching, for example.

The element models, passive radiator models, and/or shaped structure models may then be modified and additional simulations run, resulting in revised simulated beams. The simulation and modification of models may be repeated until the desired beam width, isolation, cross-polarization, resonance and input matching may be achieved. A shaped structure model may be modified such that materials (e.g., different metals, plated plastic, loaded plastic or the like), dimensions and shapes of a shaped structure may be changed. Similarly, the positioning, arrangement, shapes, dimensions and materials of models may be also be changed.

Figure 5:
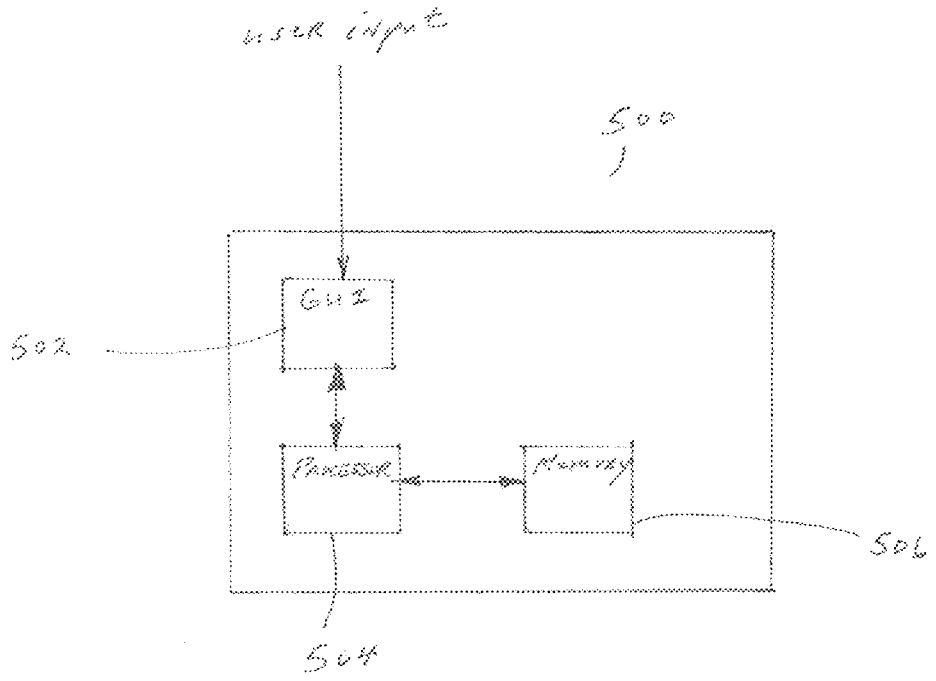
FIG. 5 shows a system for configuring an antenna structure according to an embodiment of the invention.

FIG. 5 illustrates a system 500 that may be operable to configure (e.g. design) an antenna structure according to at least one exemplary embodiment. The system 500 may include a graphical user interface (GUI) 502, a processor 504 in communication with the GUI 502 and memory 506 in communication with the processor 504. The system 500 may be a workstation, a server, a personal computer, or the like. The GUI 502 may be operable to receive user input from a keyboard, a mouse or another type of input device (not shown). Upon receiving the user input (for example) the system 500 may be operable to generate models of one or more possible antenna structures.

Figure 6:
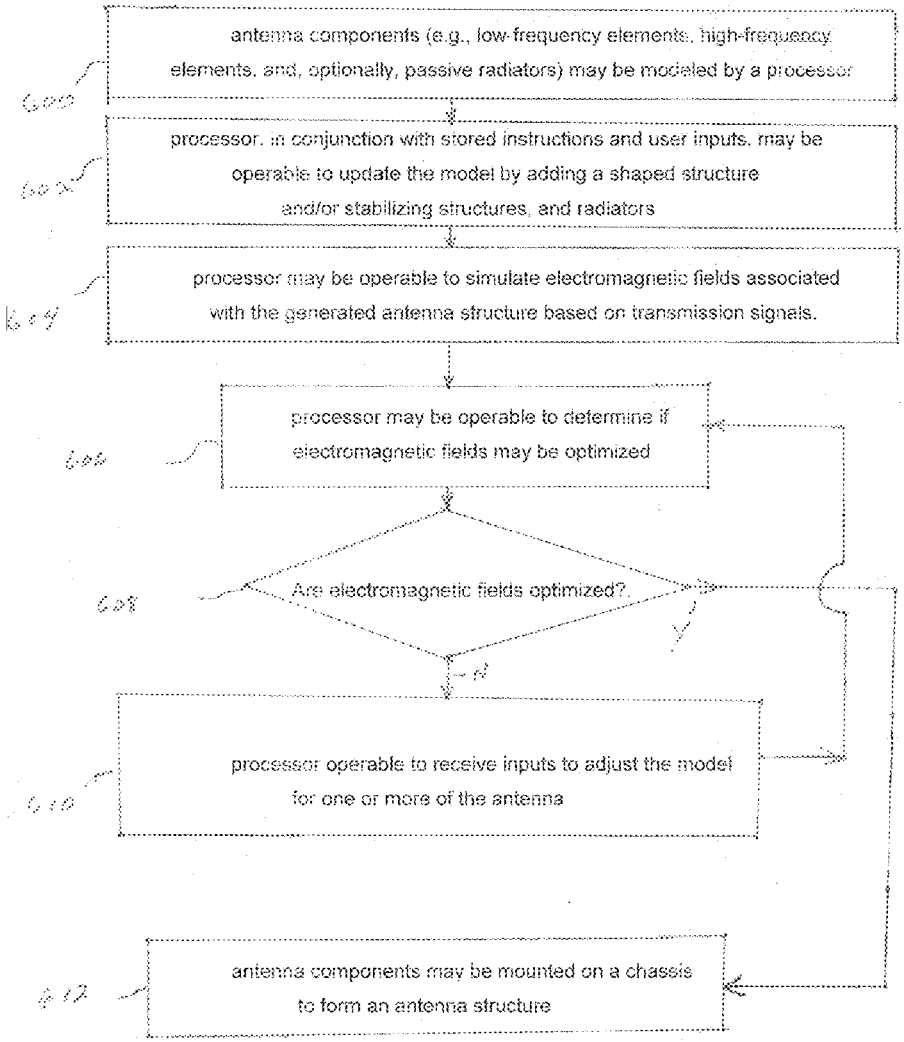
FIG. 6 illustrates a method for assembling an antenna structure according to an embodiment of the invention.

FIG. 6 illustrates a method for modeling and/or assembling (used synonymously herein) an antenna structure according to an exemplary embodiment. In step S600, antenna components (e.g., low-frequency elements, high-frequency elements, and, optionally, passive radiators) may be modeled by a processor (e.g., processor 504 of FIG. 5). In one embodiment a device or system, such as processor 504 for example, may be operable to access and execute instructions stored within memory 506 in order to generate models of antenna structures. In general, modeling is known to those skilled in the art and will not be discussed in great detail for the sake of conciseness.

In step S602 the processor 504, in conjunction with stored instructions and user inputs, may be operable to update the model by adding one or more of the antenna components described above (e.g., shaped structures, stabilizing structures, radiators, etc., collectively referred to as "antenna components").

In step S604, the processor may be operable to simulate electromagnetic fields associated with the generated antenna structure based on transmission signals. Parameters associated with the generated model may be then ported to a 3D Full-wave Electromagnetic Field Simulator or the like. Alternatively, the features and functions of the 3D Full-wave Electromagnetic Field Simulator may be implemented as instructions within memory 506, instructions that may be accessed and executed by processor 504.

In step S606, the processor 504 may be operable to determine if electromagnetic fields may be optimized. For example, as discussed above, signal characteristics (e.g., desired beam widths, isolation, cross-polarization, resonance and input matching) may be measured and analyzed for a given set of transmission signals. If it is determined (by the processor 504 for example) in step S608 that the electromagnetic fields are not optimized, the process may continue to step S610. Otherwise, the process may move to step S612.

In step S610 the processor 504 may be operable to receive inputs, from a designer for example, to adjust the model for one or more of the antenna components. Thereafter, the process may then return to step S606. Alternatively, the processor 504 may be operable to adjust the model(s) based on criteria previously entered by the designer. For example, the configuration of a shaped structure may be adjusted so that materials (e.g., different metals, plated plastic, conductive material loaded plastic or the like) and/or dimensions may be changed. Alternatively, or additionally, the arrangement, shapes, dimensions and materials of the elements and/or passive radiators may be changed.

In step S612, antenna components may be mounted on a chassis to form an antenna structure, for example. According to an alternative embodiment, one or more antenna components may be manufactured based on final models and may be installed as replacement components or supplemental components in one or more existing antenna structures, for example. One or more signal characteristics (e.g., beam widths, isolation, cross-polarization, resonance and input matching) may be measured before and after the antenna structure is completed.

While exemplary embodiments have been shown and described herein, it should be understood that variations of the disclosed embodiments may be made without departing from the spirit and scope of the invention. For example, the shapes, dimensions, positioning, configuration, transmission frequencies, and/or electrical lengths of the various components of an antenna structure may be varied provided beam stability is maintained, and/or resonance and cross-polarization problems are reduced. Yet further, related methods that provide similar operating results (e.g., beam stability) using similar antenna structures are explicitly covered by the present invention. For example, methods that comprise configuration of the exemplary structures and transmission of the exemplary frequencies discussed herein are within the scope of the present invention. That said, the scope of the invention should be determined based on the claims that follow.

I claim:

1. A broadband antenna structure comprising:

a first high-frequency, antenna radiating element operable to transmit frequencies over a first high-frequency range and a first shaped structure configured to surround sides of the first high-frequency, antenna radiating element, and operable to effect characteristics of a beam radiated from the first high-frequency, antenna radiating element; and an in-line antenna portion comprising, a second high-frequency, antenna radiating element operable to transmit frequencies over a second high-frequency range, a low-frequency, antenna radiating element operable to transmit frequencies over a low frequency range having a beam center substantially the same as a beam center of the second high-frequency, antenna radiating element, and a second shaped structure configured to surround sides of the second high-frequency, antenna radiating element, and operable to effect characteristics of a beam radiated from the second high-frequency, antenna radiating element; and first and second beam width stabilizing structures operable to provide stabilization for the first and second high-frequency elements.

2. The broadband antenna structure as in claim 1 wherein the low-frequency, antenna radiating element comprises a substantially one-piece element.

3. The broadband antenna structure as in claim 1 wherein a radiating surface of the second high-frequency, antenna radiating element is substantially aligned with a top surface of the low-frequency, antenna radiating element.

4. The broadband antenna structure as in claim 1 wherein each of the first and second shaped structures comprise a conically shaped structure.

5. The broadband antenna structure as in claim 4 wherein the conically shaped structure comprises a circular shaped top edge.

6. The broadband antenna structure as in claim 4 wherein the conically shaped structure comprises a rectangular shaped top edge.

7. The broadband antenna structure as in claim 1 wherein the low-frequency, antenna radiating element has an electrical length of ¼ wavelength.

8. The broadband antenna structure as in claim 1 wherein the low-frequency, antenna radiating element comprises a tapered portion.

9. The broadband antenna structure as in claim 1 further comprising a raised supporting section operable to support at least the second high-frequency, antenna radiating element.

10. The broadband antenna structure as in claim 1 wherein the first high-frequency, antenna radiating element is further operable to transmit frequencies over a first high-frequency range of 1700 to 2200 megahertz, the second high-frequency, antenna radiating element is further operable to transmit frequencies over a second high-frequency range of 2200 to 2700 megahertz, and the low-frequency, antenna radiating element is further operable to transmit frequencies over a low-frequency range of 698 to 960 megahertz.

11. The broadband antenna structure as in claim 1 wherein the first high-frequency, antenna radiating element is further operable to transmit frequencies over a first high-frequency range of 1700 to 2700 megahertz, the second high-frequency, antenna radiating element is further operable to transmit frequencies over a second high-frequency range of 1700 to 2700 megahertz, and the low-frequency, antenna radiating element is further operable to transmit frequencies over a low-frequency range of 698 to 960 megahertz.

12. The broadband antenna structure as in claim 1 wherein each of the stabilizing structures further comprises an extended low-frequency beam width stabilizing structure operable to provide stabilization for the low frequency element.

13. The broadband antenna structure as in claim 1 further comprising first and second tuning sections to adjust the beam width stability of the low frequency element and first and second high frequency elements.

14. A method for configuring an antenna structure comprising:

configuring a first shaped structure to surround sides of a first high-frequency, antenna radiating element, and operable to effect characteristics of a beam radiated from the first high-frequency, antenna radiating element; and configuring a second shaped structure to surround sides of a second high-frequency, antenna radiating element, and operable to effect characteristics of a beam radiated from the second high-frequency, antenna radiating element; and configuring first and second beam width stabilizing structures to provide stabilization for the first and second high-frequency elements.

15. The method as in claim 14 further comprising configuring a radiating surface of the second high-frequency, antenna radiating element to be substantially aligned with a top surface of the low-frequency, antenna radiating element.

16. The method as in claim 14 further comprising configuring a raised supporting section to support at least the second high-frequency, antenna radiating element.

17. The method as in claim 14 further comprising configuring extended low-frequency beam width stabilizing structures to provide stabilization for the low frequency element.

18. The method as in claim 14 further comprising configuring first and second tuning sections to adjust beam width stabilities of the low frequency element and first and second high frequency elements.

* * * * *